US006696015B2

(12) United States Patent
Tokuhara et al.

(10) Patent No.: US 6,696,015 B2
(45) Date of Patent: Feb. 24, 2004

(54) METHOD FOR PRODUCING RARE-EARTH MAGNET

(75) Inventors: Koki Tokuhara, Hyogo (JP); Akiyasu Oota, Hyogo (JP); Tsuyoshi Wada, Wakayama (JP); Katsumi Okayama, Shiga (JP); Tomoiku Ohtani, Osaka (JP); Kunitoshi Kanno, Hyogo (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/846,783

(22) Filed: May 2, 2001

(65) Prior Publication Data

US 2002/0012600 A1 Jan. 31, 2002

Related U.S. Application Data

(63) Continuation-in-part of application No. 09/517,493, filed on Mar. 2, 2000, now Pat. No. 6,464,931.

(30) Foreign Application Priority Data

Mar. 3, 1999 (JP) ..... 11-055247
May 2, 2000 (JP) ..... 2000-133239

(51) Int. Cl.[7] ..... B22F 3/12
(52) U.S. Cl. ..... 419/57; 419/38; 148/101
(58) Field of Search ..... 419/57, 38; 148/101

(56) References Cited

U.S. PATENT DOCUMENTS 3,655,464 A * 4/1972 Benz ..... 148/101
4,002,508 A * 1/1977 Haberer ..... 148/31.57
5,281,250 A 1/1994 Hamamura et al.
5,533,930 A * 7/1996 Tsuzuki et al. ..... 432/120
5,911,102 A * 6/1999 Takahashi et al. ..... 419/38
6,464,931 B1 * 10/2002 Oota et al. ..... 266/274

FOREIGN PATENT DOCUMENTS

JP 58-100403 6/1983
JP 63-118031 A 5/1988
JP 63-192850 A 8/1988
JP 01-108353 A 4/1989
JP 1-156404 6/1989
JP 04-299508 10/1992
JP 07-207305 A 8/1995

OTHER PUBLICATIONS

Notice of Reasons for Rejection –Issued on Aug. 19, 2003 for Japanese Application 2001–1350548. (Translation included)

* cited by examiner

*Primary Examiner*—Daniel J. Jenkins
(74) *Attorney, Agent, or Firm*—Nixon Peabody LLP; Jeffrey L. Costellia

(57) ABSTRACT

The method for producing a rare-earth sintered magnet of the present invention includes the steps of: compacting alloy powder for the rare-earth sintered magnet to form a green compact; loading the green compact into a case having a structure restricting a path through which gas flows between the outside and inside of the case, and placing a gas absorbent at least near the path; and sintering the green compact by heating the case including the green compact inside in a decompressed atmosphere.

11 Claims, 10 Drawing Sheets

METHOD FOR PRODUCING RARE-EARTH MAGNET

This is a continuation-in-part-application of a application Ser. No. 09/517,493 filed on Mar. 2, 2000 now U.S. Pat. No. 6,464,931. The contents of Japanese Patent Application No. 2000-133239 are incorporated herein by reference.

BACKGROUND OF THE INVENTION

1. Field of the Invention

The present invention relates to a method for producing a rare-earth magnet including a sintering process step and to a case for use in the sintering process.

2. Description of the Related Art

A rare-earth magnet is produced by pulverizing a magnetic alloy into powder, pressing or compacting the alloy powder in a magnetic field and then subjecting the pressed compact to a sintering process and an aging treatment. Two types of rare-earth magnets, namely, samarium-cobalt magnets and neodymium-iron-boron magnets, have found a broad variety of applications today. In this specification, a rare-earth magnet of the latter type will be referred to as an "R—T—(M)—B type magnet", where R is a rare-earth element including Y, T is Fe or a mixture of Fe and Co, M is an additive element and B is boron. The R—T—(M)—B type magnet is often applied to many kinds of electronic devices, because the maximum energy product thereof is higher than any other kind of magnet and yet the cost thereof is relatively low. However, a rare-earth element such as neodymium is oxidized very easily, and therefore great care should be taken to minimize oxidation during the production process thereof.

In the prior art process, a green compact (or as-pressed compact) obtained by compacting R—T—(M)—B type magnetic alloy powder is sintered within a furnace after the compact has been packed into a hermetically sealable container (sintering pack 100) such as that shown in FIG. 1. This is because the sintered compact would absorb too much impurity existing inside the furnace and be deformed if the compact was laid bare inside the furnace. The sintering pack 100 includes a body 101 of the size 250 mm×300 mm×50 mm, for example, and a cover 102. Inside the pack 100, multiple green compacts 80 are stacked one upon the other on a sintering plate that has been raised to a predetermined height by spacers (not shown). The sintering pack 100 may be made of SUS304, for example, which is strongly resistant to elevated temperatures.

As shown in FIG. 2, multiple sintering packs 100 are stacked on a rack (or tray) 201 with spacers 202 interposed therebetween. Then, the rack 201 is loaded into a sintering furnace in its entirety and subjected to a sintering process. After the sintering process is finished, the cover 102 is removed from each of these sintering packs 100 and the sintered compact is unloaded from the pack 100 and then transferred to another container for use in an aging treatment.

According to the conventional process, while the sintering pack 100, in which the green compacts 80 are packed, is being transported to the rack 201, the green compacts 80 might fall apart due to vibration or might have their edges chipped, thus adversely decreasing the production yield. A green compact for an R—Fe—B type magnet, in particular, has usually been compacted with lower pressure compared to a ferrite magnet so that the particle orientation thereof in a magnetic field is improved. Thus, the strength of the green compact is extremely low, and great care should be taken in handling the compact.

Also, since the sintering pack 100 is provided with the cover 102, the green compacts 80 should be loaded and unloaded into/from the pack 100 manually. This is because it is difficult to load or unload them automatically. Thus, according to the conventional technique, productivity is hard to improve.

Moreover, although SUS304, the material for the sintering pack 100, is capable of withstanding an elevated temperature of 1000° C. or more, the mechanical strength of the material at that high temperature is not so high. Due to the effect of elevated temperature on the mechanical strength of the material, if the pack 100 is continuously used in the heat for a long time, then the cover 102 might be deformed thermally or a chemical reaction might be caused between Ni contained in SUS304 and Nd contained in the green compacts 80 to erode the container. That is to say, the material is not sufficiently durable. Additionally, its lack of dimensional precision means that SUS304 is inadequate to use with automated processes.

Another problem with the use of SUS304 for sintering cases is that its thermal conductivity is relatively low. To obtain a sufficiently high heat conduction through the walls of sintering pack made of SUS304, the walls of the pack must be of a thin construction, which undesirably decreases their strength. Increasing the thickness of the walls of the pack to increase their strength results in poor conduction of heat, which increases the amount of required time required for the sintering process.

Furthermore, the present inventors have found that the sintered bodies are sometimes severely oxidized and deformed during the sintering process, even if the green compacts 80 are packed in the sintering pack 100.

SUMMARY OF THE INVENTION

An object of the present invention is providing a highly durable sintering case which exhibits excellent thermal conductivity and resistance to thermal deformation, and which will not react with rare earth elements.

Another object of the present invention is providing a sintering case, which is easily transportable and effectively applicable to an automated sintering furnace system and yet excels in shock resistance, mechanical strength and heat dissipation and absorption.

Still another object of the present invention is providing a method for producing a rare-earth magnet by performing sintering and associated processes using the inventive sintering case.

Still another object of the present invention is providing a method for producing a rare-earth magnet with high productivity by preventing compacts of rare-earth alloy powder from being oxidized during the sintering process.

A case according to the present invention is used in a sintering process to produce a rare-earth magnet. The case includes: a body with an opening; a door for opening or closing the opening of the body; and supporting means for horizontally sliding a sintering plate, on which green compacts of rare-earth magnetic alloy powder are placed. The supporting means is secured inside the body. At least the body and the door are made of molybdenum.

In one embodiment of the present invention, the body consists of: a bottom plate; a pair of side plates connected to the bottom plate; and a top plate connected to the pair of side plates so as to face the bottom plate. The door is slidable vertically to the bottom plate by being guided along a pair of guide members. The guide members are provided at one end of the side plates. In this particular embodiment, the upper end of the door is preferably folded to come into contact with the upper surface of the top plate when the door is closed.

In another embodiment of the present invention, the case may further include a plurality of reinforcing members that are attached to the body to increase the strength of the body. Each said reinforcing member includes: a first part in contact with the body; and a second part protruding outward from the first part. In this particular embodiment, the reinforcing members are preferably made of molybdenum.

In still another embodiment, the supporting means preferably includes multiple rods that are supported by the pair of side plates, and each said rod is preferably made of molybdenum.

Another case according to the present invention is used in a sintering process to produce a rare-earth magnet and is made of molybdenum.

Still another case according to the present invention is used in a sintering process to produce a rare-earth magnet and is made of molybdenum containing at least one of: 0.01 to 2.0 percent by weight of La or an oxide thereof; and 0.01 to 1.0 percent by weight of Ce or an oxide thereof.

Yet another case according to the present invention is used in a sintering process to produce a rare-earth magnet and contains 0.1 percent by weight or less of carbon and at least one of: 0.01 to 1.0 percent by weight of Ti; 0.01 to 0.15 percent by weight of Zr; and 0.01 to 0.15 percent by weight of Hf. The balance of the case is made of molybdenum.

Yet another case according to the present invention is used in a sintering process to produce a rare-earth magnet. The case includes: a casing including platelike members; and means for supporting a sintering plate, on which green compacts of rare-earth magnetic alloy powder are placed. The supporting means is provided inside the casing. The case further includes a reinforcing member provided on an outer surface of the casing.

In one embodiment of the present invention, the platelike members are preferably made of a material mainly composed of molybdenum.

An inventive method for producing a rare-earth magnet includes the steps of: pressing rare-earth magnetic alloy powder into a green compact; and sintering the green compact to form a sintered body using the case of the present invention.

In one embodiment of the present invention, the method may further include the steps of: placing the green compact on the sintering plate; loading the sintering plate, on which the green compact has been placed, into the case through the opening of the case; and closing the opening of the case with the door.

In this particular embodiment, the method may further include the steps of: performing a burn-off process on the green compact inside the case before the step of sintering the green compact is carried out; and conducting an aging treatment on the sintered body inside the case after the step of sintering the green compact has been carried out.

More specifically, the method further includes the steps of: placing the case on transport means; getting the case moved by the transport means to a position where the burn-off process is performed; and getting the case moved by the transport means to a position where the sintering step is performed.

Specifically, the opening of the case is opened before the aging treatment is performed.

In another embodiment of the present invention, powder of a neodymium-iron-boron permanent magnet may be used as the rare-earth magnetic alloy powder.

In still another embodiment, a molybdenum plate may be used as the sintering plate.

More particularly, one end of the molybdenum plate is preferably bent.

In still another embodiment, a getter (also called a "gas absorbent") may be placed inside the case. In this particular embodiment, rare-earth magnetic alloy powder or a fragment of a green compact made of rare-earth magnetic alloy powder is preferably used as the getter.

A method for producing a rare-earth magnet of the present invention includes the steps of: (a) compacting alloy powder for the rare-earth sintered magnet to form a green compact; (b) loading the green compact into a case having a structure restricting a path through which gas flows between the outside and inside of the case, and placing a getter at least near the path; and (c) sintering the green compact by heating the case including the green compact inside in a decompressed atmosphere.

The getter may be placed inside of the sintering case. Alternatively, the getter may be placed outside of the sintering case.

Preferably, the getter includes rare-earth alloy powder, and the rare-earth alloy powder has substantially the same composition as the alloy powder for the rare-earth sintered magnet.

The average particle size of the rare-earth alloy powder is preferably smaller than the average particle size of the alloy powder for the rare-earth sintered magnet. In other words, the specific surface area of the rare-earth alloy powder is preferably greater than the specific surface area of the alloy powder for the rare-earth sintered magnet.

More preferably, the rare-earth alloy powder is magnetized.

DESCRIPTION OF THE PREFERRED EMBODIMENTS

Hereinafter, preferred embodiments of the present invention will be described with reference to the accompanying drawings.

Sintering Case

Figure 1:
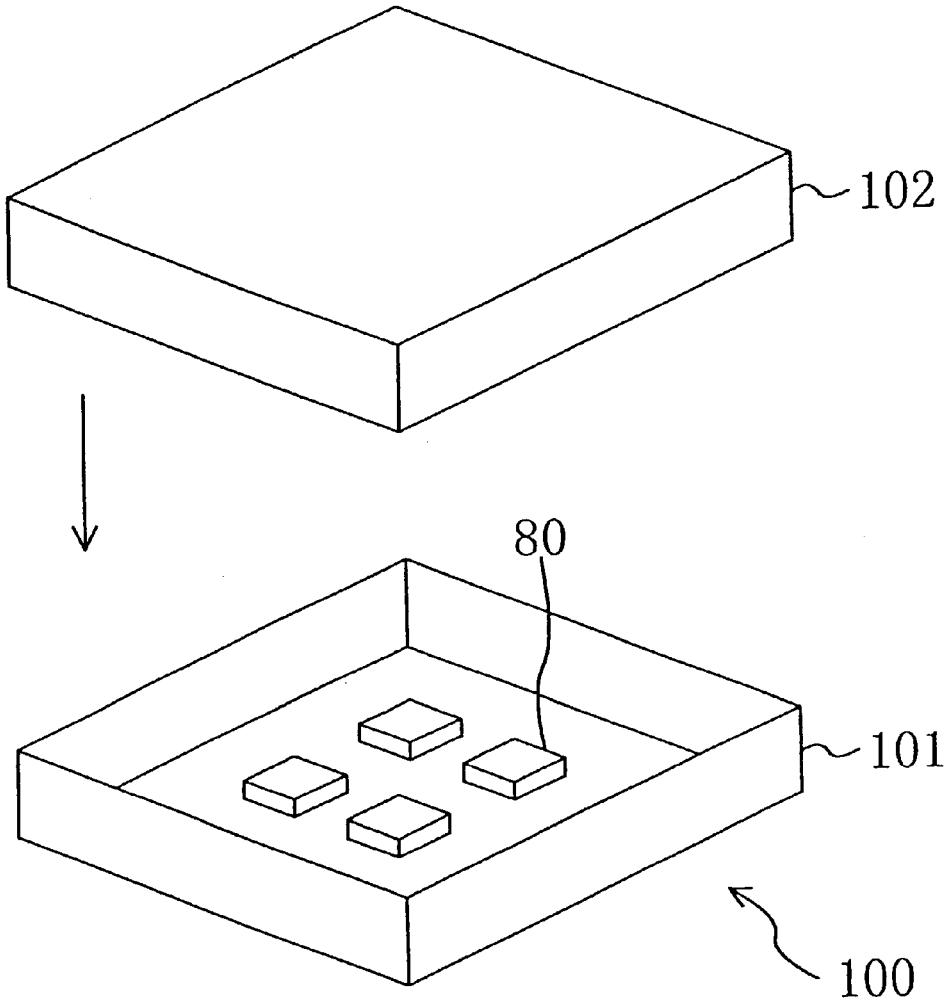
FIG. 1 is a perspective view illustrating a prior art hermetically sealable container (sintering pack), in which green compacts of R—T—(M)—B type magnetic material powder to be subjected to a sintering process are packed.
Figure 2:
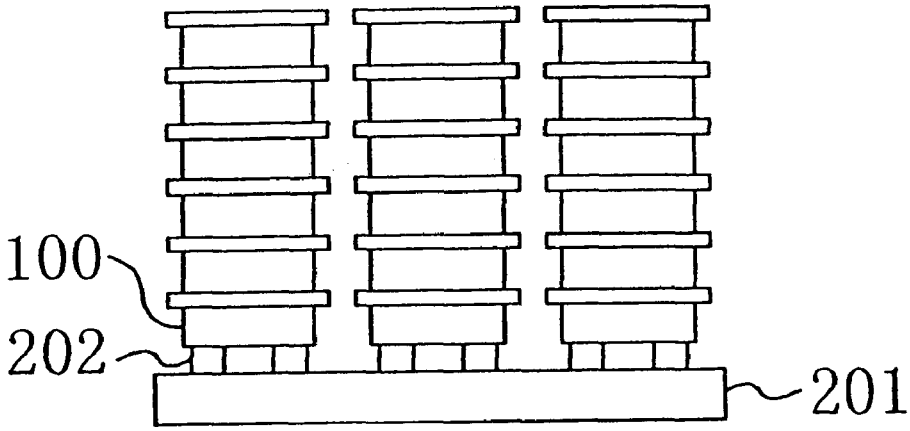
FIG. 2 is a side view illustrating a rack on which the conventional sintering packs are stacked one upon the other.
Figure 3:
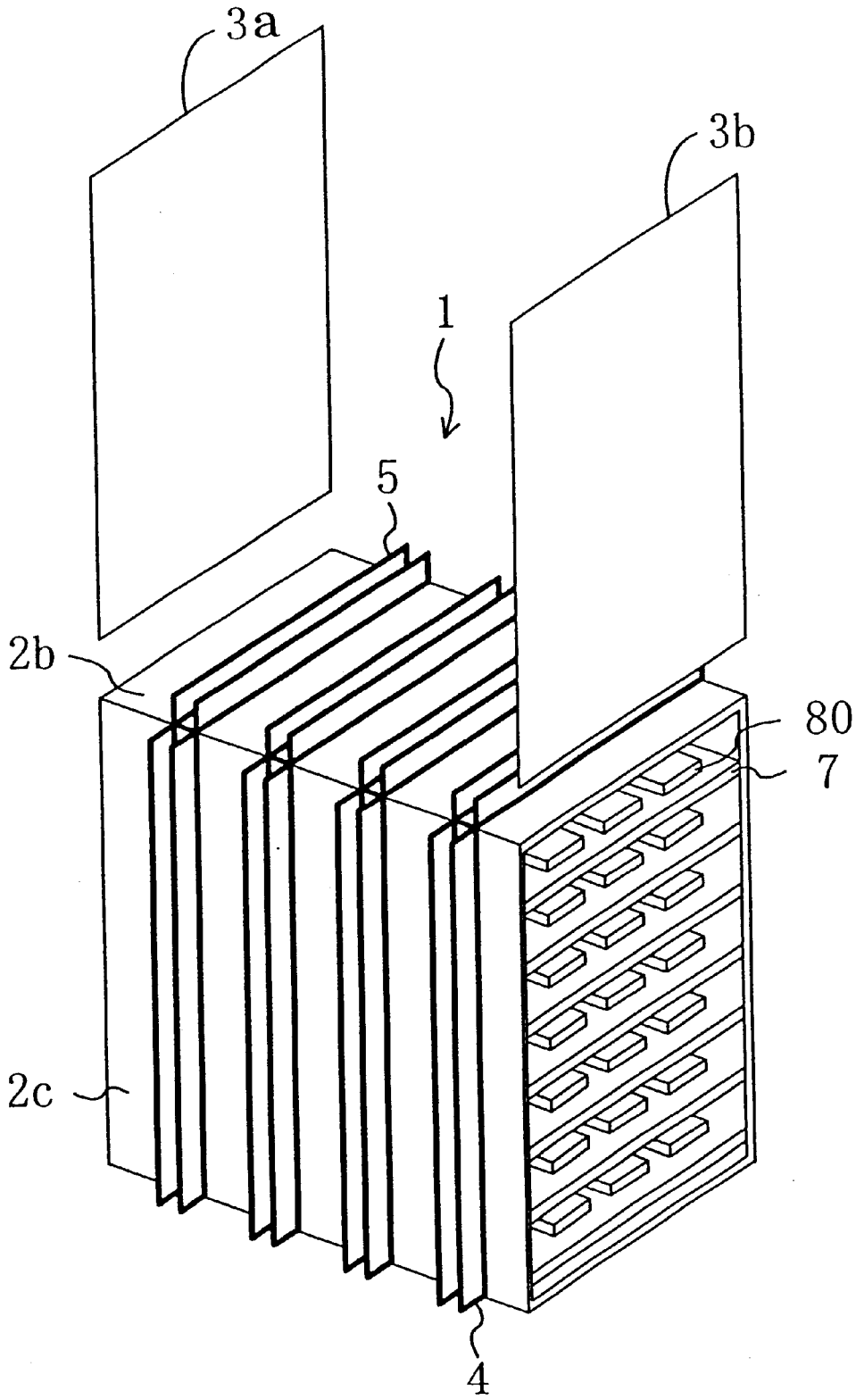
FIG. 3 is a perspective view schematically illustrating an embodiment of the inventive sintering case.
Figure 4A:
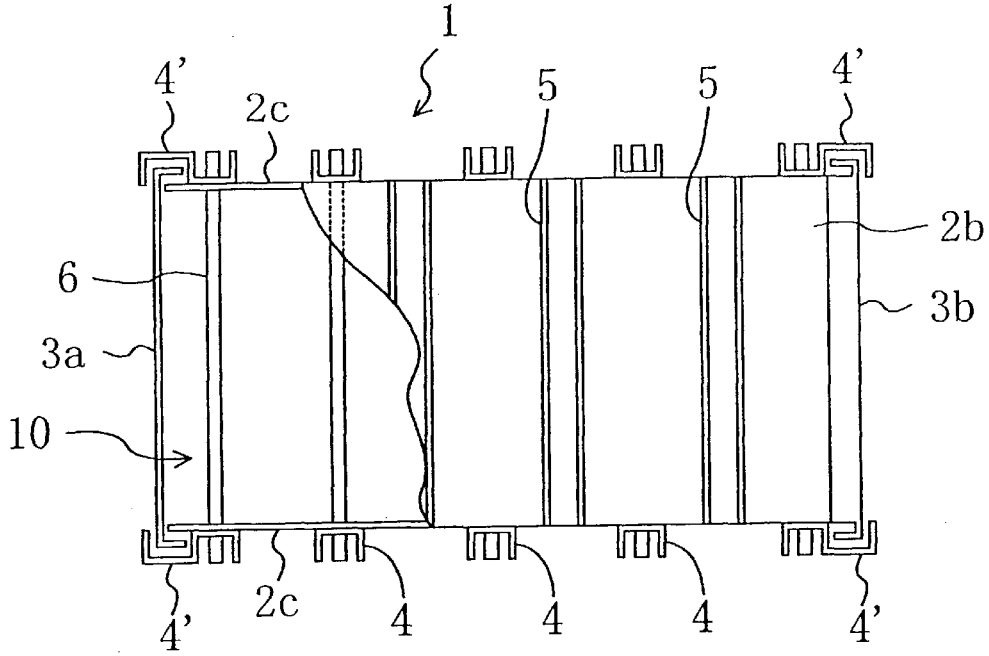
FIGS. 4A and 4B are respectively top view and side view illustrating another embodiment of the inventive sintering case.
Figure 4B:
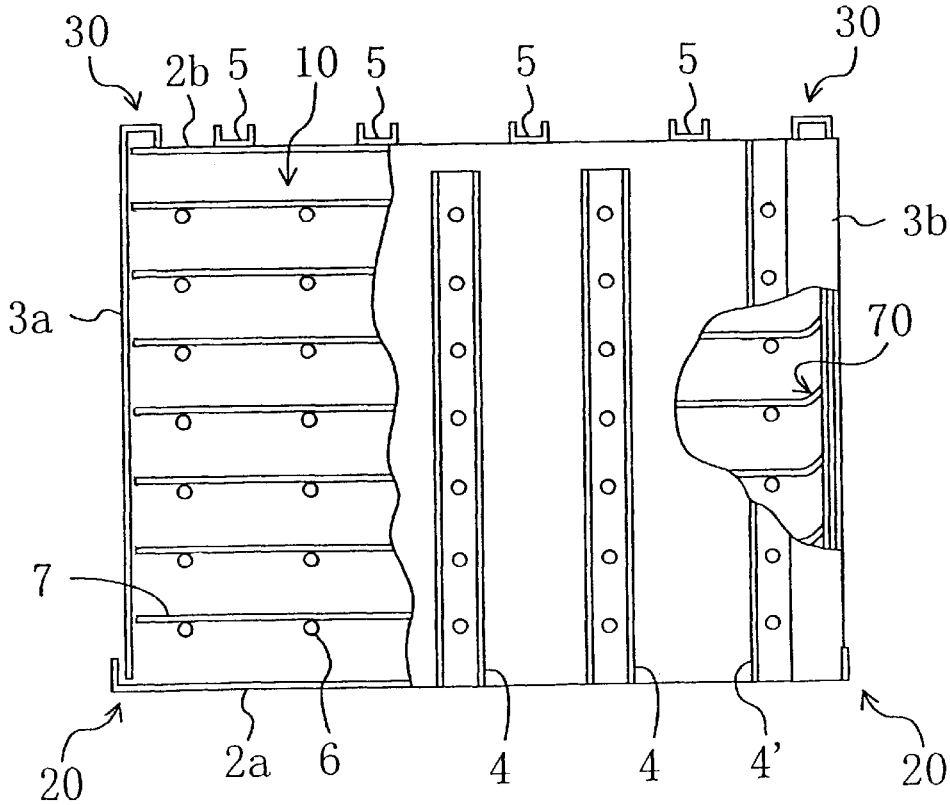

FIG. 3 is a perspective view schematically illustrating an embodiment of the inventive sintering case. FIGS. 4A and 4B respectively illustrate the top and side faces of another embodiment of the inventive sintering case. Hereinafter, a sintering case according to the present invention will be described with reference to FIGS. 4A and 4B.

The body frame 1 of the sintering case shown in FIGS. 3, 4A and 4B is made up of thin metal plates made of molybdenum with a thickness of about 1 to 3 mm. The body frame 1 is a boxlike container (or casing) with two mutually opposite sides opened, and consists of a bottom plate 2*a,* a top plate 2*b* and a pair of side plates 2*c*. The two openings of the body frame 1 are closed by two vertically slidable doors 3*a* and 3*b*. The size of the body frame 1 may be 350 mm (width)×550 mm (depth)×550 mm (height), for example.

As shown in FIGS. 4A and 4B, multiple reinforcing channel-shaped members 4 and 4' made of molybdenum are provided as members for enhancing the strength of the thin molybdenum side plates 2*c* of the body frame 1, thereby preventing the body frame 1 from being deformed. Each of the reinforcing channel-shaped members 4, 4' has a U-shaped cross section as shown in FIG. 4A. Thus, although the reinforcing channel-shaped member is thin, the channel-shaped member can exhibit sufficiently high mechanical strength and can also greatly increase the thermal conductivity (heat absorption and dissipation properties) of the body frame 1. This is particularly advantageous for controlling the temperature inside the sintering case that is sealed almost hermetically. That is to say, it takes a shorter time to heat or cool down the case to a desired temperature, thus improving the heat treatment processes such as sintering. The number and locations of the reinforcing channel-shaped members 4 and 4' are not limited to those illustrated in FIGS. 4A and 4B. Alternatively, the embodiment shown in FIG. 3 or any other embodiment may be adopted.

As shown in FIG. 4A, each of the reinforcing channel-shaped members 4' includes an inverted-U portion to guide the door 3*a* or 3*b* vertically and to increase the airtightness of the case when the doors 3*a* and 3*b* are closed. Correspondingly, both side edges of the door 3*a* or 3*b* are folded at right angles such that each of these folded edges is introduced into the space between the inverted-U portion of an associated reinforcing channel-shaped member 4' and an associated side plate 2*c*.

Each of these reinforcing channel-shaped members 4 and 4' can exhibit excellent heat dissipation and absorption properties so long as the channel-shaped member includes a first part in direct contact with the body frame 1 and at least one second fin-like part protruding outward from the first part. Accordingly, the channel-shaped member does not always have to have the U cross section, but may have, for example, an L-shaped.

In the reinforcing channel-shaped members 4 and 4' used in this embodiment, the first part, in contact with the body flame 1, may be about 20 to about 40 mm wide, while the second part may protrude outward from the body frame 1 by about 5 to about 15 mm. These sizes may be appropriately selected depending on the desired amount of reinforcement and heat conduction.

If multiple sintering plates, on each of which a large number of green compacts are placed, are loaded into a single sintering case, then the total weight of the case, plates and compacts might reach as much as 50 to 150 kilograms. Thus, the sintering case should be reinforced sufficiently. For that purpose, the mechanical strength of the top plate 2*b* is enhanced according to this embodiment by attaching similar molybdenum reinforcing channel-shaped members 5 thereto.

By using the reinforcing members such as these, each of the building plates of the body frame 1 may be thinner (e.g., thinned to a thickness of 1.0 to 2.0 mm), thus further shortening the time to heat or cool down the case.

In addition, multiple molybdenum rods 6 (diameter: about 6 to about 14 mm) extending horizontally are provided for the inner space 10 of the body frame 1. Each of these rods 6 is supported by the pair of side plates 2*c* facing each other. These rods 6 are arranged in such a manner as to support horizontally the molybdenum sintering plates 7 (thickness: 0.5 to 3 mm) with the green compacts 80 placed thereon inside the body frame 1. The rods 6 are arranged at regular intervals, i.e., about 40 to 80 mm horizontally and about 30 to 80 mm vertically. Each end of the rods 6 is joined to the reinforcing channel-shaped member 4 by means of a nut.

In the illustrated embodiment, when the door 3*a* of the body frame 1 is opened, i.e., slid upward, the sintering plates 7 with the green compacts placed thereon can be loaded through the opening into the inner space 10. In this case, the sintering plates 7 are supposed to slide horizontally on the rods 8. However, since the plates 7 and rods 6 are both made of molybdenum with high self-lubricity, just a small frictional force is created therebetween and almost no abrasion is caused. Since the openings are provided on both sides, it is easier to load green compacts into the sintering case using an automated machine like a robot. In addition, there is no need to unload the sintered body from the sintering case before an aging treatment is performed.

In the illustrated embodiment, the sintering plates 7 are also made of molybdenum. Each of these sintering plates 7 is slightly bent upward at its rightmost end 70 (angle of inclination: about 20 to 40 degrees) as shown in FIG. 4B. This shape is adopted to insert the sintering plate 7 smoothly into the case by sliding it from the left to the right in FIG. 4B without making the end of the sintering plate 7 come into contact with the rods 6.

As shown in FIG. 4B, the upper end 30 of the doors 3*a* and 3*b* is also bent such that gas is less likely to flow into, or leak out of, the case through the gap between the top plate 2*b* and the doors 3*a* and 3*b* when the doors 3*a* and 3*b* are closed. The ends 20 of the bottom plate 2*a* that are adjacent to the doors 3*a* and 3*b* are also bent at right angles to eliminate the gap between the closed doors 3*a,* 3*b* and the bottom plate 2*a*. These bent members are used to increase the airtightness of the sintering case when the doors 3*a* and 3*b* are closed.

It should be noted that a tray made of carbon or a carbon composite (not shown) is preferably attached to the bottom plate 2*a* of the body frame 1 to make the case easily transportable within a sintering furnace. The tray may be secured to the body frame 1 via pins protruding out of the tray.

In the sintering case according to this embodiment, the body frame 1 is constructed of relatively thin molybdenum plates and the molybdenum reinforcing channel-shaped members 4, 4' and 5 are provided for its side and top plates 2*c* and 2*b*. Thus, the sintering case can exhibit high mechanical strength and yet the object to be processed using this sintering case can absorb or dissipate heat quickly. As a result, the time taken to perform the sintering process can be shortened considerably. In particular, since molybdenum, which not only excels in thermal conductivity but also does not react with Nd unlike Ni contained in stainless steel, is used according to the present invention, the durability of the case can be far superior to the stainless steel one.

Examples of imaginable metal materials other than molybdenum with excellent thermal conductivity include Cu and W. However, these materials are less preferable than molybdenum for the inventive sintering case. This is because Cu has insufficient strength and W is harder to shape. Fe is not preferable either, because Fe is likely to be deformed when heated or cooled down rapidly.

In view of these respects, the present invention has been described as being applied to a molybdenum sintering case. Alternatively, the sintering case may also be made of a material, which is mainly composed of molybdenum but contains other elements in small amounts. Specifically, the sintering case may also be made of molybdenum containing at least one of: 0.01 to 2.0 percent by weight of La or an oxide thereof; and 0.01 to 1.0 percent by weight of Ce or an oxide thereof. This alternative material is not only excellent in thermal conductivity, but also less likely to be hardened because molybdenum does not recrystallize at the sintering temperature of a rare-earth magnet (i.e., 1000 to 1100° C.). Accordingly, a sintering case made of this material has increased shock resistance and can be used repeatedly many times, because the case neither fractures nor cracks even when applied to an automated line. Also, by adding these impurities to molybdenum, processability is also improved compared to pure molybdenum.

As another alternative, the sintering case may also be made of a material containing: (a) 0.1 percent by weight or less of carbon; (b) at least one of 0.01 to 1.0 percent by weight of Ti, 0.01 to 0.15 percent by weight of Zr and 0.01 to 0.15 percent by weight of Hf; and (c) molybdenum as the balance. Similar effects to those attainable by molybdenum containing 0.01 to 2.0 percent by weight of La or an oxide thereof and/or 0.01 to 1.0 percent by weight of Ce or an oxide thereof can be attained in such a case.

Method for Producing Rare-earth Magnet

Hereinafter, a method for producing a magnet for a voice coil motor (VCM) will be described as an exemplary embodiment of the inventive method for producing a rare-earth magnet.

First, rare-earth magnetic alloy powder is prepared by known techniques. In this embodiment, cast flakes of an R—T—(M)—B alloy are obtained by a strip-casting technique to produce an R—T—(M)—B type magnetic alloy. The strip-casting technique is disclosed in U.S. Pat. No. 5,383,978, for example. The contents of U.S. Pat. No. 5,383,978 are incorporated herein by reference. Specifically, an alloy, which contains 30 wt % of Nd, 1.0 wt % of B, 0.2 wt % of Al and 0.9 wt % of Co and the balance of which is Fe and inevitable impurities, is melted by a high frequency melting process to form a melt of the alloy. The molten alloy is kept at 1350° C. and then quenched by a single roll process to obtain a thin alloy with a thickness of 0.3 mm. The quenching process is performed under the conditions that the circumferential speed of the chill roll surface is about 1 m/sec., the cooling rate is about 500° C./sec. and sub-cooling degree is 200° C.

The quenched alloy is roughly pulverized by a hydrogen absorption process and then finely pulverized using a jet mill within a nitrogen gas environment. As a result, alloy powder with an average particle size of about 3.5 $\mu$m is obtained.

Then, 0.3 wt % of a lubricant is added to the alloy powder obtained in this manner and mixed with the powder in a rocking mixer, thereby covering the surface of the alloy powder particles with the lubricant. A fatty acid ester diluted with a petroleum solvent is preferably used as the lubricant. In this embodiment, methyl caproate is preferably used as the fatty acid ester and isoparaffin is preferably used as the petroleum solvent. The weight ratio of methyl caproate to isoparaffin may be 1:9, for example.

Next, the alloy powder is compacted using a press to form a green compact in a predetermined shape (size: 30 mm×40 mm×80 mm). The green density of the as-pressed compact may be set at about 4.3 g/cm$^3$, for example. After the green compact has been formed by the press, the compact is placed onto the sintering plate 7. In this case, multiple green compacts may be placed on a single sintering plate 7. The door 3*a* is slid upward to open the opening of the body 1 and several sintering plates 7, on each of which the green compacts are placed, are loaded into the sintering case. This loading operation is preferably performed automatically using a robot. Thereafter, the door 3*a* is closed to create a substantially airtight condition within the sintering case. In this case, an inert gas is preferably supplied into the sintering case to minimize the exposure of the green compacts to the air. The space inside the sintering case is not airtight completely, and therefore, the air flows into the sintering case little by little with time. Even so, the oxidation of the green compacts can be substantially suppressed compared to a situation where the green compacts are in direct contact with the air.

Also, rare-earth magnetic alloy powder or a fragment of a green compact made of rare-earth magnetic alloy powder is preferably placed as a getter inside the sintering case, e.g., on the sintering plates. Specifically, the getter should be placed at least near a region through which a gas expectedly flows into or leaks out of the case, e.g., at least near the gap between the body frame 1 and the door 3*a* or 3*b* of the sintering case. The getter does not have to be the rare-earth magnetic alloy powder or a fragment thereof so long as the getter can trap a gas that easily reacts with the magnetic material powder contained in the green compacts. However, the fragment or powder of the as-pressed compact of the rare-earth magnet is preferred because the fragment or powder not only shows high reactivity against a gas, which easily reacts with the magnetic material powder contained in the green compacts, but also is easily available.

Figure 5:
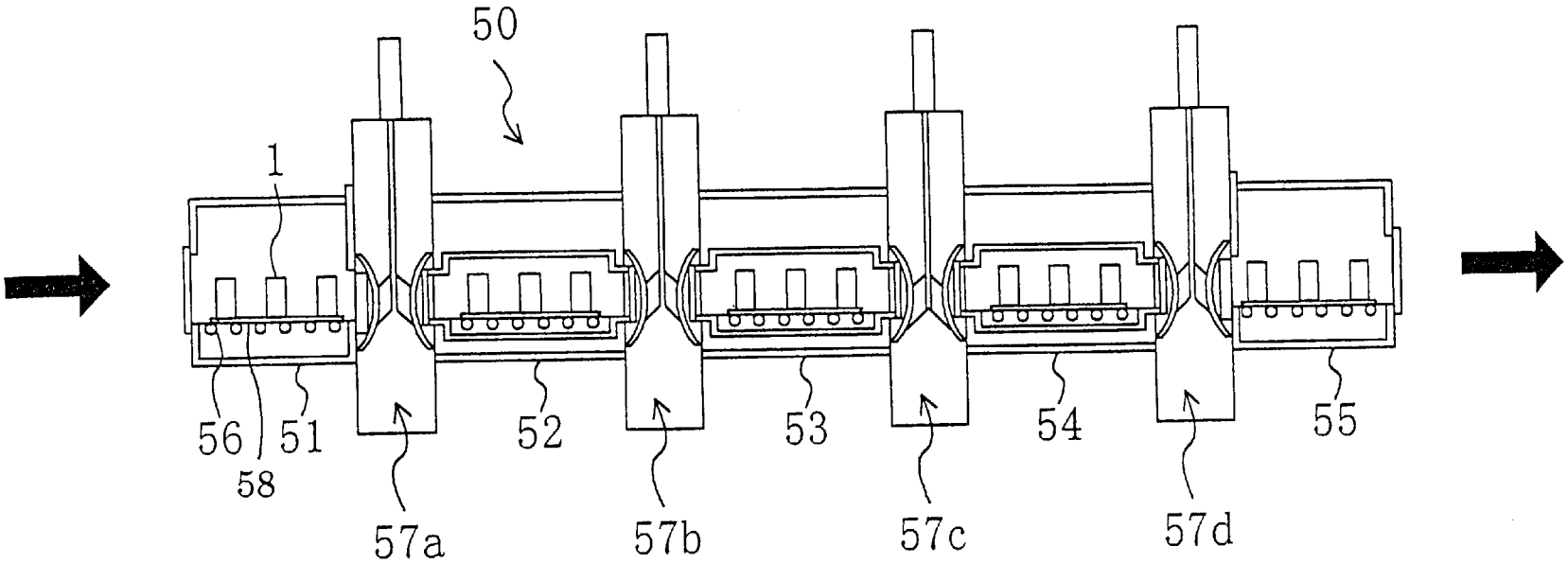
FIG. 5 schematically illustrates a sintering furnace system suitably applicable to an inventive method for producing a rare-earth magnet.

The sintering case, in which a large number of green compacts are loaded, is mounted on a sintering tray 58 and transported to a sintering furnace system 50 shown in FIG. 5 by an automatic transporter, for example. The sintering tray 58 is formed of, for example, a carbon or a carbon composite (e.g., carbon fiber reinforced carbon composite (c/c composite) available from Across Co., Ltd.). These materials are preferable because of their high thermal insulating property and high heat resistance. A sintering cart may be used instead of the sintering tray 58.

The sintering furnace system 50 includes a preparation chamber 51, a burn-off chamber 52, a first sintering chamber 53, a second sintering chamber 54 and a cooling chamber 55. Adjacent chambers are linked together via a coupling 57*a*, 57*b*, 57*c* or 57*d*. These couplings 57*a* through 57*d* are so constructed as to transport the sintering case through the processing chambers without exposing the case to the air. In this sintering furnace system 50, the sintering case mounted on the tray 58 is carried by rollers 56 and stops at each of these chambers to be subjected to each required processing for a predetermined time. Each process is carried out in accordance with a recipe that has been appropriately selected from a plurality of preset recipes. To improve the mass productivity, all the processes performed in these processing chambers are preferably under the systematic computerized control of a CPU, for example. In this embodiment, optimum known processes may be performed depending on the type of a rare-earth magnet to be produced. Hereinafter, the respective processes will be briefly described.

First, at least one sintering case is loaded into the preparation chamber 51 located at the entrance of the sintering furnace system 50 and the preparation chamber 51 is closed airtight and evacuated until the ambient pressure reaches about 2 Pa to prevent oxidation. Then, the sintering case is transported to the burn-off chamber 52, where a burn-off process (i.e., a lubricant removal process) is carried out at a temperature of 250 to 600° C. and at a pressure of 2 Pa for 3 to 6 hours. The burn-off process is performed to volatilize the lubricant covering the surface of the magnetic powder before the sintering process is carried out. The lubricant has been mixed with the magnetic powder prior to the press compaction to improve the orientation of the magnetic powder during the press compaction, and exists among the particles of the magnetic powder. During the burn-off process, various types of gases are generated from the as-pressed compacts, but the getter can also function as an absorbent (or trap) of these gases.

After the burn-off process is finished, the sintering case is transported to the sintering chamber 53 or 54, where the case is subjected to a sintering process at 1000 to 1100° C. for 2 to 5 hours. Thereafter, the sintering case is transported to the cooling chamber 55 and cooled down until the temperature of the sintering case reaches about room temperature.

Next, the sintering case is unloaded from the sintering furnace system 50, the doors 3*a* and 3*b* thereof are slid upward and removed completely and then the sintering case is inserted into an aging treatment furnace, where an ordinary aging treatment is performed on the case. The doors 3*a* and 3*b* may be opened or closed either manually or automatically. The aging treatment may be performed for about 1 to 5 hours within an ambient gas at a pressure of about 2 Pa and at a temperature of 400 to 600° C. According to this embodiment, there is no need to unload the green compacts from the sintering case when the aging treatment is performed. Thus, compared to the conventional process, the number of process steps and/or working time can be reduced.

In an actual process, multiple sintering cases are loaded into the processing chambers at a time and subjected to the same process in each of these chambers. A great number of, e.g., 200 to 800, green compacts can be packed within a single sintering case. In addition, respective process steps can be efficiently performed in parallel. For example, while the sintering process is being carried out in the sintering chamber, sintering cases that have already been subjected to the sintering process can be cooled down in the cooling chamber. In the meantime, other sintering cases that will soon be subjected to the sintering process can also be processed in the burn-off chamber.

In general, it takes a relatively long time to perform a sintering process. Thus, a plurality of sintering chambers are preferably provided as shown in FIG. 5 such that a great number of sintering cases can be subjected to the sintering process at the same time. In that case, sintering processes may be performed in respective sintering chambers under mutually different conditions.

According to this embodiment, the case can be thinner than the conventional one, not only because the case is made of molybdenum with excellent thermal conductivity but also because the case is provided with the reinforcing members with the U cross section. Thus, even if the sintering process is carried out in completely the same way as the prior art process, the processing time can be shortened by as much as about 10%. In addition, the molybdenum sintering case is hard to deform thermally and has such a construction as allowing the green compacts to be loaded and unloaded into/from the case easily. Thus, the molybdenum case is suitably applicable to an automated procedure and contributes to reduction in number of required process steps and/or working time and improvement in throughput of the production process. Furthermore, since the green compacts are much less likely to fall apart during transportation, the production yield can be improved by 1%.

The oxidation prevention effect obtained by use of a getter including rare-earth alloy powder described in relation with the sintering case described above is also obtained when other types of sintering cases are used. In other words, oxidation of green compacts during sintering as well as deformation and degradation of the magnetic property due to the oxidation can be suppressed by loading the green compacts into a case having a structure restricting a path through which gas flows between the outside and inside of the case, and sintering the green compacts in the presence of a getter placed at least near the path. That is to say, the getter is placed so that gas passes near the getter or through the getter to flow between the outside and the inside of the case.

As the getter, rare-earth alloy powder is preferably used. Such rare-earth alloy powder can be substantially the same as the alloy powder for rare-earth sintered magnets. For example, fragments of a green compact and compact defectives may be used. This enables effective use of the rare-earth alloy material and also eliminates the necessity of extra material cost for the getter. In addition, for effective exertion of the function as the getter, compact defectives and fragments of a green compact are preferably pulverized. This pulverization may be performed with a mechanical pulverizing device such as a jaw crusher or pin mill. In addition, the getter may be obtained by hydrogen pulverizing sintered body defectives or further pulverizing by means of a mechanical pulverizing device such as a disk mill or power mill. Furthermore, it is preferable to finely pulverize the obtained powder to increase the specific surface area of the powder and improve the gas absorbing function of the powder.

A getter functions more effectively as the surface area of the getter is larger. Therefore, the average particle size of rare-earth alloy powder used as the getter is preferably smaller than that of the rare-earth alloy powder for sintered magnets. For example, while the average particle size of the rare-earth alloy powder for sintered magnets is preferably in the range of 1.5 to 7 $\mu$m, for example, from the standpoint of the magnetic properties and compactibility, the average particle size of the rare-earth alloy powder used as the getter is preferably in the range of 1.0 to 5 $\mu$m for example.

Magnetized powder may be used as the rare-earth alloy powder. This provides an advantage that the getter can be placed in gaps in the sintering case efficiently by utilizing the aggregation of the powder with the magnetic force.

The reason why rare-earth alloy powder is preferably used as the getter is as follows.

In the field of powder metallurgy, in general, in order to prevent a green compact from being oxidized with oxygen or water vapor in the sintering process, adopted are a method in which a hydrogen gas atmosphere is used as the sintering atmosphere and a method in which a getter more susceptible to oxidation than the green compact (typically, metal Ti powder) is used. In sintering of rare-earth alloy powder, however, none of these methods are adoptable. If a hydrogen atmosphere is used, the crystal structure of the resultant rare-earth alloy sintered body changes due to a phenomenon known as hydrogen desproportionation desorption and recombination (HDDR), failing to provide desired magnetic properties.

Rare-earth elements are materials very susceptible to oxidation. Therefore, the general getter such as metal Ti powder fails to function as the getter for rare-earth alloy powder. Only metal calcium (Ca) is oxidized more easily than rare-earth elements. However, if calcium is used as the getter, the calcium attaching to the surfaces of the sintering case, the sintering plate, and the sintering tray may be changed to calcium hydroxide in the course of repeated use of the case and the like. The calcium hydroxide releases water when heated in the sintering furnace, and this causes oxidation of the rare-earth element. Moreover, metal calcium may possibly ignite when exposed to the atmosphere.

Even if Ca is not used as the getter, a very small amount of Ca and Mg are contained in a rare-earth alloy material, and Ca and Mg are deposited on the surfaces of the sintering case, the sintering plate, the sintering tray, and a sintering cart during the sintering process. In this case, also, hydroxides of Ca and Mg may be generated on the surfaces, because Ca and Mg absorb water in the atmosphere in the course of repetition of transportation of green compacts from the atmosphere into the furnace and vice versa. This causes oxidation of the green compacts, because the hydroxides of Ca and Mg release water during the sintering process. Furthermore, even if Ca and Mg are not contained in the material, a hydroxide of the rare-earth element may be generated on the surfaces of the sintering case and the sintering plate, causing water to be brought into the sintering furnace (Japanese Patent Gazette No. 2754098, for example). Water and a hydroxide attaching to an inner surface of the sintering furnace may also be a cause of oxidation of the green compacts.

Not only the water and hydroxides attaching to the solid surfaces (the sintering case, the sintering tray, and the sintering cart) in the sintering furnace described above are the cause of generation of oxidizable gas. Water and oxygen may also enter the sintering furnace due to imperfection of the furnace (leakage in the furnace).

The getter including rare-earth alloy powder placed at least near a path through which gas enter the sintering case is oxidized itself with the oxidizable gas such as water vapor and oxygen entering the sintering case, to thereby prevent oxidation of the rare-earth alloy powder for sintered magnets constituting the green compact. The getter may be placed outside or inside of the sintering case so that the getter can contact with the gas attempting to enter or entering the sintering case.

Hereinafter, this mechanism will be described in more detail.

As the sintering case is heated in the sintering furnace controlled to a predetermined atmosphere, sintering of the green compacts inside the sintering case proceeds. For example, water which had been adsorbed to the surface of a green compact loaded in the sintering case in the atmosphere is desorbed from the surface of the green compact during the heating of the compact to about 200° C. The desorbed water is discharged outside of the sintering case and then outside of the sintering furnace. During this heating, the temperature of the green compact is sufficiently low, and thus the rare-earth alloy powder is hardly oxidized.

It is substantially impossible to heat the inside of the sintering furnace uniformly and thus a temperature distribution is generated. Therefore, there exists a region in the sintering furnace in which the temperature is lower (i.e., the rate of temperature rise is lower) than that of the green compact. Typically, the rate of temperature rise is low in the lower portion of the sintering furnace. To be more specific, the sintering tray and cart are heated more slowly than the green compact. As a result, it is after the temperature of the green compact rises to the range of 300° C. to 400° C. or more that water attaching to the sintering tray and cart (including water generated by thermal decomposition of hydroxides of Ca and Mg and a hydroxide of the rare-earth element) is released in the sintering furnace. The released water enters the sintering case while diffusing in the sintering furnace. By this time, the temperature of the green compact has reached the level allowing the compact to be oxidized with the water. In addition, since this occurs at the early stage of the sintering, it is considered that exposure of the green compact to water vapor at this stage causes the oxidation of the green compact and reduction in density (i.e., deformation) of the resultant sintered body due to a lack of a liquid phase which must be formed during the sintering process for complete sintering of the green compact.

According to the present invention, the getter, which is placed at least near the path to the sintering case, is oxidized with the water vapor to consume the water vapor before the water vapor reaches the green compact, to thereby block the water vapor from the green compact. The getter, along with the green compact, is heated up to a temperature at which the getter can react with (i.e., absorb) the water vapor. In this way, for prevention of reduction in density of the sintered body, it is important to prevent the green compact of which the temperature is about 300° C. or more and which has not been sintered sufficiently from being exposed to water vapor. Once the compact has been sintered sufficiently, the compact has been contracted sufficiently. At this stage, therefore, the resultant sintered body is free from reduction in density (i.e., deformation) even if the compact is oxidized. The getter also has a function of trapping oxygen entering the sintering case, not only the water vapor described above. The sintered body is therefore prevented from being oxidized.

Thus, the present invention can provide a method for producing a rare-earth sintered magnet, which can sufficiently suppress oxidation of the rare-earth element and exhibits high productivity.

Hereinafter, another example of the sintering case used for the method for producing a rare-earth sintered magnet according to the present invention will be described with reference to the relevant drawings.

Figure 6A:
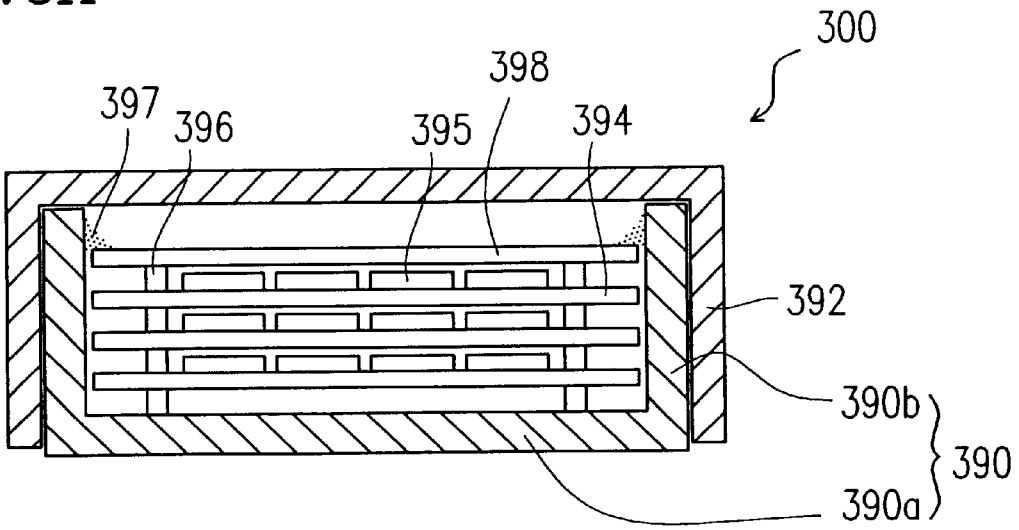
FIG. 6A is a cross-sectional view of a sintering case used for an inventive method for producing a rare-earth sintered magnet.
Figure 6B:
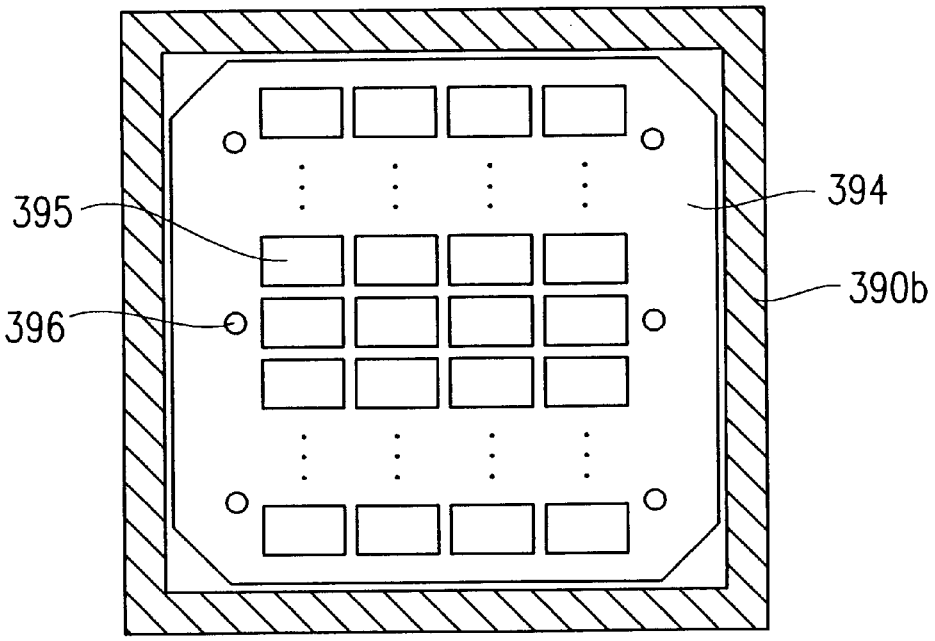
FIG. 6B is a plan view of the sintering case from which the lid has been removed.

Referring to FIGS. 6A and 6B, a sintering case 300 is essentially composed of a bottom container 390 including a bottom plate 390*a* and a sidewall 390*b* and a lid 392 for covering the bottom container 390. A plurality of sintering plates 394 are stacked one upon the other in the bottom container 390 with spacers 396 interposed therebetween for separating the adjacent plates 394 by a predetermined distance. On each of the sintering plates 394, placed are multiple green compacts 395 obtained by compacting alloy powder for magnets. The sintering case 300 is heated to about 1000° C. or more, for example, in the sintering process. Therefore, the bottom container 390 and the lid 392 are made of a material durable against high temperature (for example, SUS310 and molybdenum).

The sidewall 390*b* of the bottom container 390 surrounds the peripheries of the sintering plates 394 and also supports the lid 392 at the top end thereof. The space defined by the sidewall 390*b* (storage space) is designed to have a horizontal lateral size larger slightly (by several millimeters to several centimeters) than the size of the sintering plates 394 so that only a small gap is formed between the sidewall 390*b* and the sintering plates 394. A reason for setting a small gap between the sidewall 390*b* and the sintering plates 394 is to enable loading of as many green compacts 395 as possible in the sintering case 300 by securing the sintering plates 394 of the largest possible size, to thereby improve the loading efficiency of the sintering furnace. The small gap between the sidewall 390*b* and the sintering plates 394 has another advantage of preventing the sintering plates 394 from moving in the sintering case 300, causing falling of the spacers standing on the sintering plates 394, even when the sintering case 300 is subjected to vibration during transportation and the like.

A getter 397 is placed at least near a path through which gas flows between the outside and inside of the sintering case 300, for absorbing impurity gas (mainly, water vapor and oxygen). The getter may also be placed in the path so that the getter blocks the gas flow through the path. More specifically, an inner lid 398 (for example, a plate similar to the sintering plates) is mounted above the top sintering plate 394 on which the green compacts 395 are placed. The getter 396 in the form of powder or small lumps is pressed in so that the gap between the inner lid 398 and the sidewall 390*b* of the bottom container 390 is filled with the getter 396. The gap between the inner lid 398 and the sidewall 390*b* is made sufficiently small so that the getter 397 can be placed over the gap to fill the gap.

The getter 397 first comes into contact with a gas flowing into the sintering case 300 from outside. If the gas includes a gas reactive with the green compacts 395, such as water vapor and oxygen, the getter 397 reacts itself with the gas to consume the gas and thus to prevent the green compacts from being exposed to the gas. The getter 397, which includes rare-earth alloy powder, has substantially the same reactivity as the green compact 395 and thus reacts with all kinds of gases reacting with the green compacts 395. The getter 397 is preferably made of rare-earth alloy powder having substantially the same composition as the rare-earth alloy powder constituting the green compacts 395. Compact defectives and fragments of a green compact may be used as the getter 397. In addition, in order to enhance the function of the getter 397, the defectives and fragments are preferably pulverized to produce rare-earth alloy powder having an average particle size smaller than the alloy powder constituting the green compacts 395. Defectives and fragments of sintered body may also be used as the getter. It is preferable to use roughly or finely pulverized sintered body.

Figure 7:
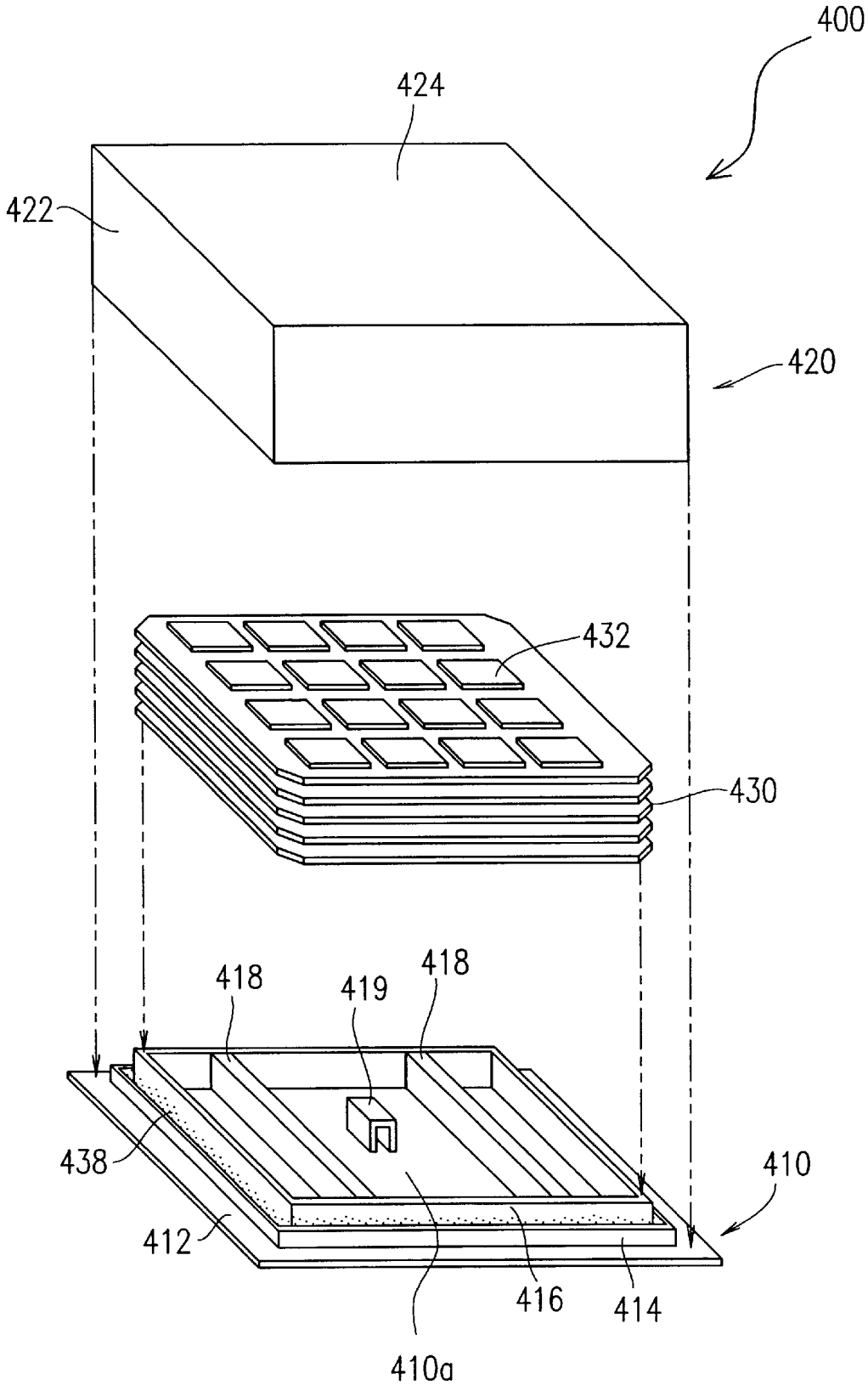
FIG. 7 is an exploded perspective view schematically illustrating another sintering case used for the inventive method for producing a rare-earth sintered magnet.
Figure 8A:
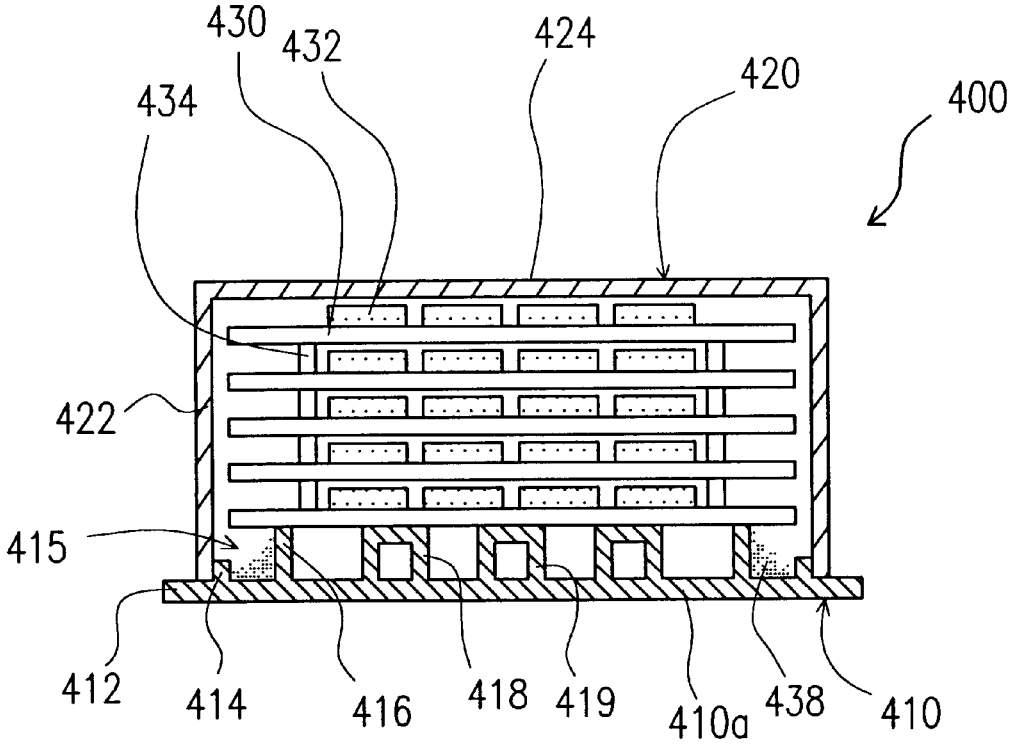
FIG. 8A is a cross-sectional view illustrating the entire of the sintering case shown in FIG. 7.
Figure 8B:
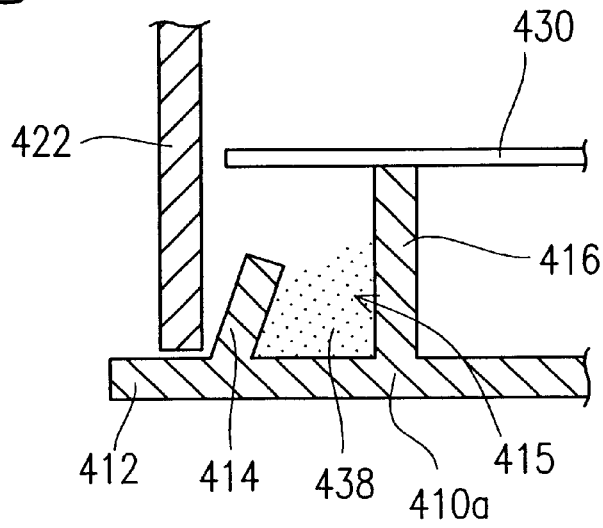
FIG. 8B is a partial enlarged view of FIG. 8A.
Figure 9:
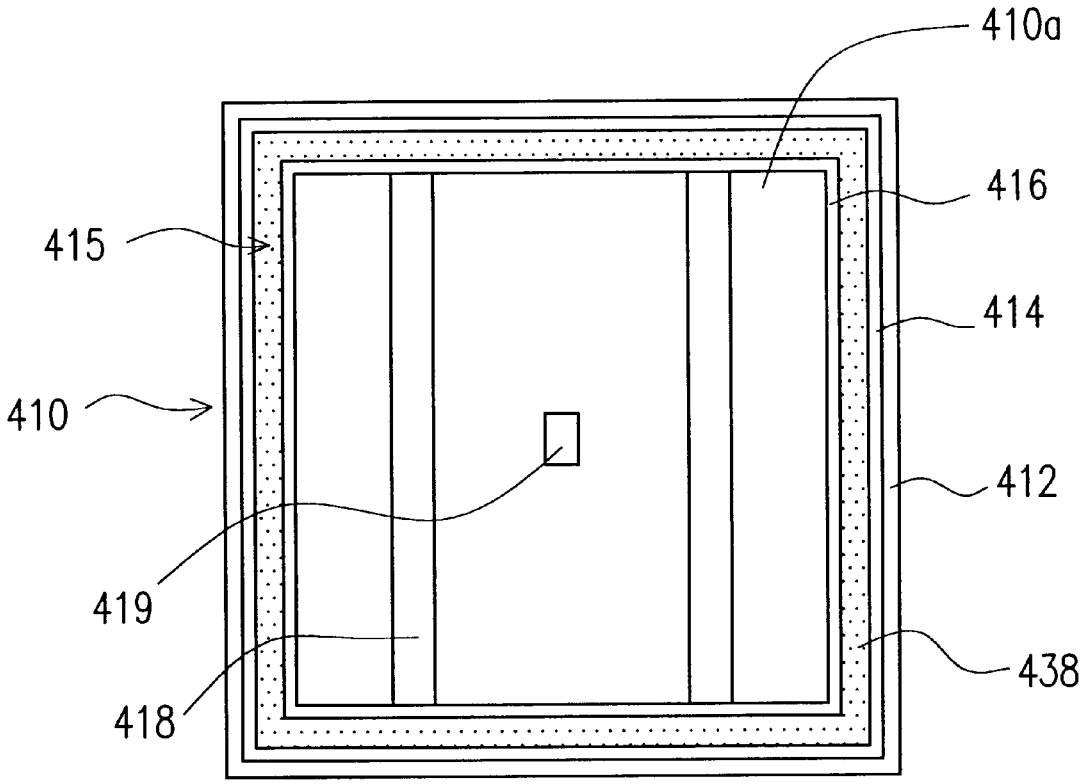
FIG. 9 is a plan view of a bottom plate of the sintering case shown in FIG. 7.

Next, yet another sintering case 400 will be described with reference to FIGS. 7 through 9. The sintering case 400 provides easier loading of green compacts than the sintering case 300 described above, and thus is suitable for automated loading of green compacts.

The sintering case 400 is essentially composed of a bottom plate 410 for supporting sintering plates 430 and a lid 420 for covering the bottom plate 410. Into the sintering case 400, a plurality of sintering plates 430 are loaded in the state of a stack. That is, the sintering plates 430 are in advance stacked one upon the other with pillar spacers 434 interposed therebetween for separating the adjacent plates 430 by a predetermined distance. On each of the sintering plates 430, placed are multiple green compacts 432 obtained by compacting alloy powder for magnets.

The lid 420 includes a sidewall portion 422 and a top portion 424, made of a refractory metal. In the state of the lid 420 being put on the bottom plate 410, the sidewall portion 422 surrounds the peripheries of the sintering plates 430, and the top portion 424 covers the top surface of the top sintering plate 430. The shape and size of the top portion 424 are determined depending on the shape and size of the sintering plates 430. The gap between the sidewall portion 422 and the sintering plates 430 is preferably set in the range of 3 to 10 mm. Thus, the sidewall portion 422 surrounds the sintering plates 430 with substantially no gap therebetween. This facilitates loading of the sintering plates 430 into the sintering case 400, and also suppresses displacement of the sintering plates 430 inside the sintering case 400 during transportation and the like. The lid 420 is less likely to deform with heat because it has the sidewall portion 422.

The bottom plate 410 includes a flat plate portion 410*a* made of a refractory metal. A periphery portion 412 is formed around the periphery of the flat plate portion 410*a* to serve as a support against which the bottom end face of the sidewall portion 422 of the lid 420 can abut. As shown in FIGS. 8A and 8B, the periphery portion 412 preferably has a protrusion extending outside from the sidewall portion 422 of the lid 420 when the lid 420 is put on the bottom plate 410. Having such a protrusion, the sintering case 400 can be easily loaded and unloaded by grasping the protrusion when the sintering case 400 is covered with the lid 420.

On the flat plate portion 410*a* of the bottom plate 410, formed are an outer peripheral wall 414 protruding upward near the periphery portion 412 and an inner peripheral wall 416 located inside from the outer peripheral wall 414. The outer peripheral wall 414 comes into contact with the inner surface of the sidewall portion 422 when the lid 420 abuts against the periphery portion 412, thereby blocking horizontal movement of the lid 420. As shown in FIG. 8B, the outer peripheral wall 414 may be tilted at an angle of 15°, for example, inwardly from the normal to the flat plate portion 410*a*. With this configuration, the lid 420 can be easily put on the bottom plate 410 without being blocked by the outer peripheral wall 414. The inner peripheral wall 416, which is taller than the outer peripheral wall 414, supports the sintering plate 430 at the top end face thereof. The outer and inner peripheral walls 414 and 416 also function as reinforcing materials for preventing deformation of the bottom plate 410 together with reinforcing members 418 to be described later.

A getter 438 is filled in a space (retaining groove) 415 formed between the outer and inner peripheral walls 414 and 416, for absorbing impurity gas (mainly, water vapor and oxygen). The getter 438 filled in the retaining groove 415 is located near a path through which gas flows between the outside and inside of the sintering case 400 when the lid 420 is put on the bottom plate 410.

Figure 10A:
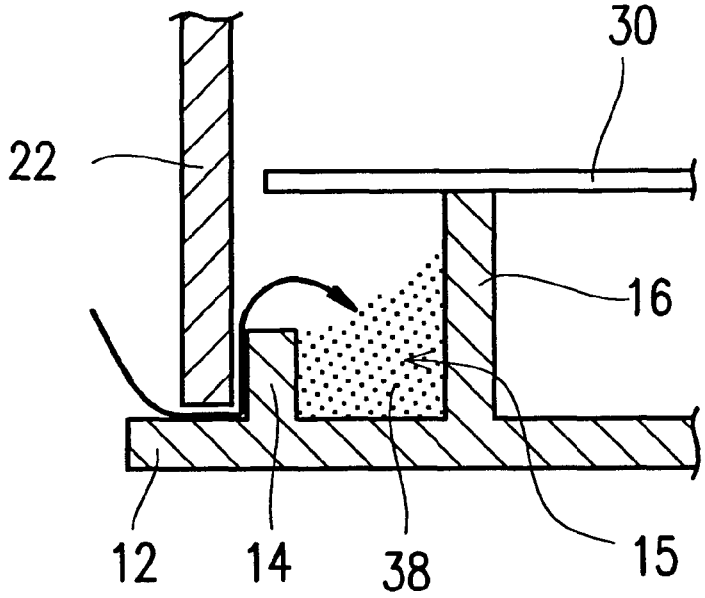
FIGS. 10A and 10B are views illustrating how a getter retained on the bottom plate absorbs gas attempting to enter the case from outside.

As shown in FIG. 10A, the getter 438 can absorb impurity gas flowing into the sintering case from outside. That is, the getter 438 prevents impurity gas such as water vapor and/or oxygen present in the sintering furnace from flowing into the sintering case and undesirably reacting with the sintered body.

The getter 438 must be replaced every sintering process. Therefore, the retaining groove 415 desirably has a shape and size suited for easy removal of the getter 438. For this purpose, the distance between the outer and inner peripheral walls 414 and 416 (i.e., the width of the retaining groove 415) is preferably set in the range of 5 to 15 mm, and the height of the outer peripheral wall 414 is preferably set in the range of 5 to 10 mm.

For effective absorption of gas by the getter 438, the exposure area of the getter 438 is preferably as large as possible. For this purpose, the height of the inner periphery wall 416 is preferably set larger to some extent than (for example, set about 1.5 times as large as) that of the outer periphery wall 414, and the getter 438 is preferably heaped in the retaining groove 415 so that the top surface of the heap is inclined upward from the outer peripheral wall 414 toward the inner peripheral wall 416.

The outer and inner peripheral walls 414 and 416 constituting the retaining groove 415 may otherwise be formed of an elongate member made of a refractory metal, curved along the length direction to have the U cross section. A total of four such members are placed on the flat plate portion 410*a* as if they correspond to the four sides of a square, and the bottom portions of the members are secured to the flat plate portion 410*a* by welding, to thereby form the outer and inner peripheral walls 414 and 416.

Figure 10B:
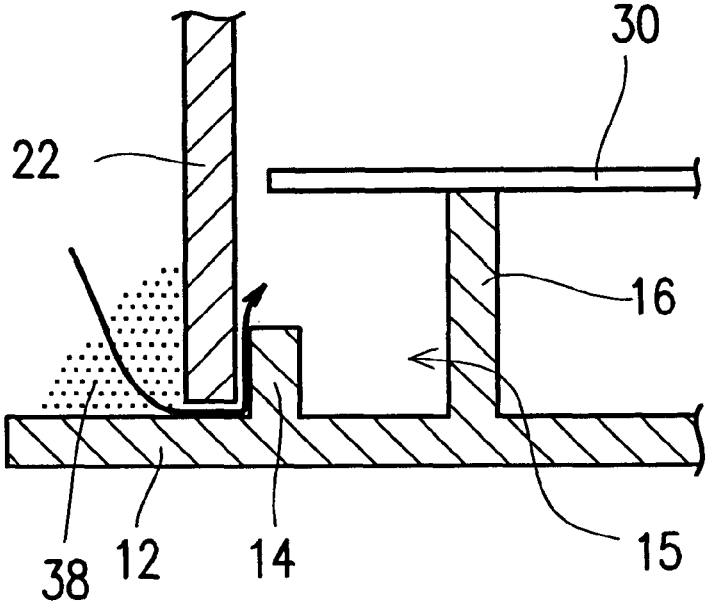

Alternatively, the getter may be placed outside of the case, as shown in FIG. 10B. This arrangement is advantageous in that the getter placed outside of the case may be easily removed after the sintering process. On the other hand, in the case where the getter is placed inside of the case, relatively small amount of the getter may effectively absorb the oxidizable gas. Of course, the getter may be placed on both sides of the case in order to ensure the gas absorbing effect.

Referring back to FIGS. 7 through 9, the illustrated bottom plate 410 further includes: two elongate reinforcing members 418 extending in parallel with each other on the flat plate portion 410*a* (on the surface of the bottom plate 410); and a support member 419 located in the center of the surface of the bottom plate 410.

The reinforcing members 418 are provided for the bottom plate 410 for the following reason. While the bottom container 390 of the sintering case 300 (see FIGS. 6A and 6B) less easily deforms with heat because it has the sidewall 390*b*, the bottom plate 410 may possibly generate deformation such as warpage, causing reduction in hermeticity of the sintering case. The reinforcing members 418 are provided to prevent this occurrence. The reinforcing members 418 may be in any form, but the parallel arrangement of two elongate members as shown in FIGS. 7 through 9 can appropriately prevent deformation of the bottom plate 410. When the reinforcing members 418 are made of a hollow material as shown in cross section in FIG. 8A, it is possible to prevent the heat capacity of the entire bottom plate 410 from largely increasing, in addition to obtaining the effect that the bottom plate 410 can be appropriately reinforced. Thus, the green compacts can be heated efficiently in the sintering process and the like. The both ends of the elongate reinforcing members 418 may be put in contact with the opposing surface of the inner peripheral wall 416, to integrate the reinforcing members 418 and the inner peripheral wall 416 into one. This further improves the strength of the bottom plate 410.

The support member 419 provided in the center of the surface of the bottom plate 410 has substantially the same height as the inner peripheral wall 416. The support member 419 prevents the sintering plate 430 placed thereon from bending and thus suppresses deformation of the sintered bodies placed on the sintering plate 430.

In the use of the sintering case 400 of this embodiment, a plurality of sintering plates 430 on which the green compacts 432 are placed are in advance stacked one upon the other with the spacers 434 therebetween. The stack of the plates is then placed on the inner peripheral wall 414 of the bottom plate 410, and the bottom plate 410 is covered with the lid 420. This procedure eliminates the necessity of loading the sintering plates one by one into the sintering case, as is required for the sintering case 300. In addition, the sintering case 400 eliminates the necessity of loading the sintering plates on which green compacts are placed into a deep case with unstable support, as is required for the sintering case 300. This reduces the possibility of cracking and chipping of the green compacts during the loading. Moreover, it is not necessary to cut the edges of the sintering plates to provide gaps from the sidewall of the container, as is required for the sintering plates 394 loaded in the sintering case 300. It should be noted however that the edges of the sintering plates are preferably cut to some extent to provide beveling for prevention of cracking. The loading of the green compacts into the sintering case may be made either manually or automatically.

The size of the flat plate portion 410*a* of the bottom plate 410 of the sintering case 400 is 280 mm (length)×315 mm (width)×1 mm (thickness), for example. The outer size of the lid 420 is 270 mm (length)×305 mm (width)×60 mm (height) with a thickness of 1.5 mm, for example. The bottom plate 410 and the lid 420 are made of a material durable against heating in the sintering process and the like, for example, refractory metals such as stainless steel and molybdenum. When SUS310 is used for the sintering case 400, deformation of the sintering case with heat can be reduced compared with the case of using SUS 304.

The size of the sintering plates 430 is 250 mm (length)× 300 mm (width)×1 mm (thickness), for example. The sintering plates 430 are preferably made of molybdenum. Molybdenum is a suitable material for the sintering plates 430 because it has low reactivity with green compacts, good thermal conductivity, and good heat resistance.

The inventive method for producing a rare-earth magnet is applicable not just to the magnet with the above composition, but also to various R—T—(M)—B type magnets in general. Such magnets are disclosed in U.S. Pat. No. 4,770,723. For example, according to the present invention, a material containing, as the rare-earth element R, at least one element selected from the group consisting of Y, La, Ca, Pr, Nd, Sm, Gd, Tb, Dy, Ho, Er, Tm and Lu may be used. Also, to attain sufficient magnetization, at least one of Pr and Nd should account for 50 atomic percent or more of the rare-earth element R. If the rare-earth element R accounts for 10 atomic percent or less of the magnetic material, then the coercivity of the resultant magnet will decrease because α-Fe phases are deposited. Conversely, if the rare-earth element R exceeds 20 atomic percent, then secondary R-rich phases are unintentionally deposited in addition to the desired tetragonal $Nd_2Fe_{14}B$ compounds, resulting in decrease of magnetization. Thus, the rare-earth element R preferably accounts for 10 to 20 atomic percent of the material.

T is a transition metal element containing Fe or Fe and Co. If T accounts for less than 67 atomic percent of the material, then the magnetic properties deteriorate because the secondary phases with low coercivity and low magnetization are formed. Nevertheless, if T exceeds 85 atomic percent of the material, then α-Fe phases are grown to decrease the coercivity and the shape of the demagnetization curve is degraded. Thus, the content of T is preferably in the range from 67 to 85 atomic percent of the material. Although T may consist of Fe alone, T preferably contains Co, because Curie temperature is increased and the temperature dependency of the magnet improves in such a case. Also, Fe preferably accounts for 50 atomic percent or more of T. This is because if Fe accounts for less than 50 atomic percent of T, the saturation magnetization itself of the $Nd_2Fe_{14}B$ compound decreases.

B is indispensable to form the tetragonal $Nd_2Fe_{14}B$ crystal structure stably. If B added is less than 4 atomic percent of the material, then $R_2T_{17}$ phases are formed and therefore coercivity decreases and the shape of the demagnetization curve is seriously deteriorated. However, if B added exceeds 10 atomic percent of the material, then secondary phases with weak magnetization are grown unintentionally. Thus, the content of B is preferably in the range from 4 to 10 atomic percent of the material.

To improve the magnetic anisotropy of the powder, at least one element selected from the group consisting of Al, Ti, Cu, V, Cr, Ni, Ga, Zr, Nb, Mo, In, Sn, Hf, Ta and W may be mixed as an additive. But the magnetic material powder may include no additive at all. An additive mixed preferably accounts for 10 atomic percent of the material or less. This is because if the additive exceeds 10 atomic percent of the material, then secondary phases, not ferromagnetic phases, are deposited to decrease the magnetization. No additive element M is needed to obtain magnetically isotropic powder. However, Al, Cu or Ga may be added to improve the intrinsic coercivity.

According to the present invention, even if a sintering process is carried out in the same way as the prior art process, the processing time still can be shortened considerably. In addition, the inventive case has such a construction as allowing the green compacts to be loaded and unloaded into/from the case easily. Thus, the inventive case is suitably applicable to an automated procedure and contributes to reduction in number of required process steps or working time and significant improvement in throughput of the production process. Furthermore, since the green compacts are much less likely to fall apart during transportation, the production yield can be improved.

These effects of the present invention are also attainable even if the present invention is applied to producing a sintered magnet other than the R—T—(M)—B type magnet.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method for producing a rare-earth sintered magnet comprising the steps of:

compacting alloy powder for the rare-earth sintered magnet to form a green compact;

providing a sintering case which includes a container and a sintering plate wherein the sintering case has a structure forming a gap through which gas flows from outside of the sintering case;

placing the green compact onto the sintering plate, placing the sintering plate within the container and placing a gas absorbent at least near the gap;

placing the sintering case in a sintering chamber, and heating the sintering case while inside the sintering chamber; and sintering the green compact.

2. A method for producing a rare-earth sintered magnet according to claim 1, the gas absorbent is placed on the inside of the sintering case.

3. A method for producing a rare-earth sintered magnet according to claim 1, wherein the gas absorbent includes rare-earth alloy powder.

4. A method for producing a rare-earth sintered magnet according to claim 3, wherein the rare-earth alloy powder has substantially the same composition as the alloy powder for the rare-earth sintered magnet.

5. A method for producing a rare-earth sintered magnet according to claim 3, wherein the average particle size of the rare-earth alloy powder is smaller than the average particle size of the alloy powder for the rare-earth sintered magnet.

6. A method for producing a rare-earth sintered magnet according to claim 3, wherein the rare-earth alloy powder is magnetized.

7. A method for producing a rare-earth sintered magnet according to claim 1, wherein the alloy powder for the rare-earth sintered magnet comprises an R—T—(M)—B magnet material where R is a rare earth element, T is Fe or a mixture of Fe and Co, M is an additive element and B is boron.

8. A method for producing a rare-earth sintered magnet according to claim 1, wherein the gas absorbent is placed in the gas flow path within the sintering case to block the path of the gas through the gap toward the green compact.

9. A method for producing a rare-earth sintered magnet according to claim 1, wherein the gas absorbent is placed in the container after placing the sintering plate within the container.

10. A method for producing a rare-earth sintered magnet according to claim 1, wherein the gas absorbent is placed in the container prior to placing the sintering plate within the container.

11. A method for producing a rare-earth sintered magnet according to claim 1, wherein the gas absorbent is placed at least near the gap on the outside of the sintering case.

* * * * *